US012583494B2

(12) United States Patent
Oswald et al.

(10) Patent No.: US 12,583,494 B2
(45) Date of Patent: Mar. 24, 2026

(54) VEHICLE CONTROL SYSTEM AND METHOD

(71) Applicant: Transportation IP Holdings, LLC, Norwalk, CT (US)

(72) Inventors: James A. Oswald, Cedar Rapids, IA (US); Alan Tentinger, Germantown, MD (US); Alex Young, Cedar Rapids, IA (US); Phillip A. Burgart, Cedar Rapids, IA (US); Ann K. Grimm, Cedar Rapids, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 134 days.

(21) Appl. No.: 18/415,779

(22) Filed: Jan. 18, 2024

(65) Prior Publication Data

US 2024/0317284 A1 Sep. 26, 2024

Related U.S. Application Data

(60) Provisional application No. 63/491,798, filed on Mar. 23, 2023.

(51) Int. Cl.

| | |
|---|---|
| ***B61L 27/16*** | (2022.01) |
| ***B61L 27/20*** | (2022.01) |
| ***B61L 27/40*** | (2022.01) |
| ***B61L 27/60*** | (2022.01) |

(52) U.S. Cl.

CPC ..... *B61L 27/16* (2022.01); *B61L 27/20* (2022.01); *B61L 27/40* (2022.01); *B61L 27/60* (2022.01)

(58) Field of Classification Search

CPC ..... B61L 27/16; B61L 27/20; B61L 27/40; B61L 27/60

See application file for complete search history.

(56) References Cited

U.S. PATENT DOCUMENTS

| | | | | |
|---|---|---|---|---|
| 9,702,715 | B2 * | 7/2017 | Cooper | G01C 21/3415 |
| 2013/0090801 | A1 * | 4/2013 | Backes | B61L 23/28 701/23 |
| 2014/0094998 | A1 * | 4/2014 | Cooper | B61L 15/0036 701/2 |
| 2016/0311423 | A1 * | 10/2016 | Storm | B60L 50/40 |
| 2020/0117204 | A1 * | 4/2020 | Lindemann | B60L 53/63 |
| 2020/0149996 | A1 * | 5/2020 | Seenumani | F02B 63/047 |
| 2022/0135039 | A1 * | 5/2022 | Jardine | B60W 30/18163 701/26 |

* cited by examiner

*Primary Examiner* — Phutthiwat Wongwian
*Assistant Examiner* — Susan E Scharpf
(74) *Attorney, Agent, or Firm* — K&L Gates LLP

(57) ABSTRACT

A control system and method includes obtaining information associated with a vehicle system that includes one or more vehicles that are configured to move along a route. The vehicle system information is applied to a trip simulation to determine how the vehicle system is expected operate while the vehicle system moves along the route. The trip simulation includes one or more anticipated operating conditions of the vehicle system and/or anticipated route conditions the vehicle system is expected to be exposed to as the vehicle system moves along the route. It is determined whether the vehicle system will be able to stop at one or more locations along the route based on the application of the vehicle system information to the trip simulation. An alert is communicated responsive to determining that the vehicle system will be unable to stop at the one or more locations along the route.

20 Claims, 3 Drawing Sheets

VEHICLE CONTROL SYSTEM AND METHOD

CROSS-REFERENCE TO RELATED APPLICATIONS

The application claims priority to U.S. Provisional Application No. 63/491,798, filed on 23 Mar. 2023. The entirety of this application is incorporated herein by reference.

BACKGROUND

Technical Field

The subject matter described herein relates to systems and methods that control operation of powered systems, such as vehicles or vehicle systems (formed from single or multiple vehicles).

Discussion of Art

Prior to a vehicle system embarking on a trip, the configuration or make-up of the vehicle system may need to be verified. The configuration of the train may need to be understood in order for operating settings of the vehicle system to be accurate. As one example, if the actual number of vehicles included in the vehicle system is different than the assumed number of vehicles in the configuration, then the vehicle system may not be able to operate safely, the vehicle system may be unable to adhere to speed limits along the route, may be unable to stop at required stopping locations, etc.

In certain instances, the assumed configuration of a vehicle system may be manually verified, such as by an operator of the vehicle system. For example, an operator may manually count the number of vehicles of the vehicle system, and compare the actual number of vehicles with the number of vehicles in the assumed configuration. If the actual number is different than the assumed number, then one or more operating settings of the vehicle system may need to be adjusted in order to safely control operation of the vehicle system.

It may be desirable to have a verification system and method that differs from those that are currently available.

BRIEF DESCRIPTION

In accordance with one example or aspect, a method includes obtaining information associated with a vehicle system that includes one or more vehicles that are configured to move along a route. The vehicle system information is applied to a trip simulation to determine how the vehicle system is expected operate while the vehicle system moves along the route. The trip simulation includes one or more anticipated operating conditions of the vehicle system and/or anticipated route conditions the vehicle system is expected to be exposed to as the vehicle system moves along the route. It is determined whether the vehicle system will be able to stop at one or more locations along the route based on the application of the vehicle system information to the trip simulation. An alert is communicated responsive to determining that the vehicle system will be unable to stop at the one or more locations along the route.

In accordance with another example or aspect, a control system includes one or more processors that obtain information associated with a vehicle system. The vehicle system includes two or more vehicles that are configured to move along a route. The processors apply the vehicle system information to a trip simulation to determine how the vehicle system is expected to operate while the vehicle system moves along the route. The trip simulation includes one or more of anticipated operating conditions of the vehicle system and/or anticipated route conditions the vehicle system is expected to be exposed to as the vehicle system moves along the route. The processors determine whether the vehicle system will be able to stop at one or more locations along the route based on the application of the vehicle system information to the trip simulation. Responsive to determining that the vehicle system will be unable to stop at the one or more locations along the route, the processors generate an alert.

In accordance with another example or aspect, a method includes applying vehicle system information to a trip simulation to determine how a vehicle system is expected operate during upcoming movement of the vehicle system along a route. The trip simulation includes one or more of anticipated operating conditions of the vehicle system and/or anticipated route conditions the vehicle system is expected to be exposed to during the upcoming movement of the vehicle system along the route. A determination is made whether the vehicle system will exceed a determined operating threshold at one or more locations along the route based on the application of the vehicle system information to the trip simulation. The vehicle system may be allowed to move along the route responsive to determining that the vehicle system will not exceed the determined operating threshold, or the vehicle system may be prohibited from moving along the route responsive to determining that the vehicle system will exceed the determined operating threshold.

BRIEF DESCRIPTION OF THE DRAWINGS

The subject matter may be understood from reading the following description of non-limiting embodiments, with reference to the attached drawings, wherein below.

DETAILED DESCRIPTION

Embodiments of the subject matter described herein relate to a system (e.g., a vehicle control system) and method for examining how a vehicle system will operate. Information associated with the vehicle system may be obtained, and may be applied to a trip simulation to determine how the vehicle system is expected to operate. For example, the trip simulation may be a model of an upcoming portion of a route along which the vehicle system is expected to move. The trip simulation model may include anticipated operating conditions of the vehicle system (e.g., brake settings, propulsion or throttle settings, a distribution of braking and/or propulsion efforts along a length of the vehicle system, or the like) and anticipated route conditions (e.g., grades, curvatures, types of routes, expected traction levels, or the like). If the application of the vehicle system information to the trip simulation model indicates that the vehicle system will be able to stop at a target destination or within a target destination range, then the vehicle system may be allowed to move along the route. Alternatively, if the application of the vehicle system information to the trip simulation model indicates that the vehicle system will be unable to stop, or be controlled according to one or more other rules or regulations at different locations along the route, the vehicle system may be prohibited from moving along the route.

While one or more embodiments are described in connection with a rail vehicle system, not all embodiments are limited to rail vehicle systems. Unless expressly disclaimed or stated otherwise, the subject matter described herein extends to other types of vehicle systems, such as automobiles, trucks (with or without trailers), buses, marine vessels, aircraft, mining vehicles, agricultural vehicles, or other off-highway vehicles. The vehicle systems described herein (rail vehicle systems or other vehicle systems that do not travel on rails or tracks) may be formed from a single vehicle or multiple vehicles. With respect to multi-vehicle systems, the vehicles may be mechanically coupled with each other (e.g., by couplers) or logically coupled but not mechanically coupled. For example, vehicles may be logically but not mechanically coupled when the separate vehicles communicate with each other to coordinate movements of the vehicles with each other so that the vehicles travel together (e.g., as a convoy).

Figure 1:
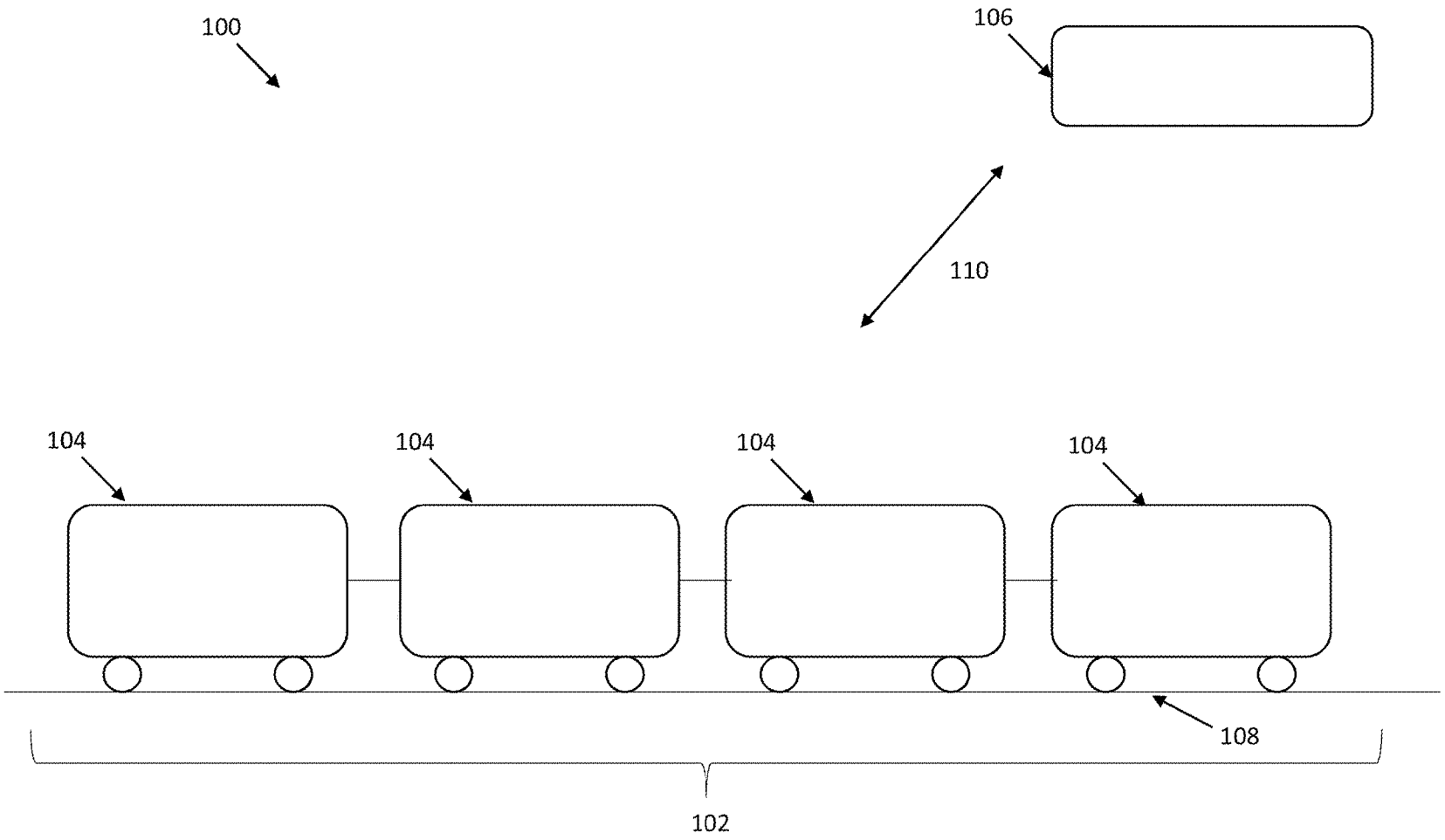
FIG. 1 illustrates a schematic of a vehicle control system, in accordance with one embodiment.

FIG. 1 illustrates a vehicle control system 100 in accordance with one embodiment. The vehicle control system may include various devices and systems that operate to control operation of a vehicle system 102. The vehicle system can include one or more powered systems, such as vehicles 104, that may travel together along a route 108. In the illustrated embodiment of FIG. 1, the vehicle system includes four vehicles that are mechanically coupled together. The vehicles may be propulsion-generating vehicles (e.g., locomotives) or non-propulsion-generating vehicles (e.g., rail cars). In alternative embodiments, the vehicle system may include less than four or more than four vehicles, and the vehicles may be mechanically coupled and/or mechanically separated but logically coupled with each other in any combination. In one or more embodiments, the vehicle system may include any number of propulsion-generating vehicles and any number of non-propulsion-generating vehicles.

The vehicle control system can include an off-board control system 106 that may be communicatively coupled with the vehicle system. In one or more embodiments, the off-board control system may include a controller (not shown) that represents hardware circuitry connected with and/or including one or more processors that perform the operations described herein in connection with the control system. The off-board control system may represent a dispatch facility, such as a back-office server, a data center, or the like. The off-board control system may include a communication system (not shown) that allows direct and/or indirect communication 110 between the vehicle system and the off-board control system. The off-board control system may communicate directly with one or more vehicles of the vehicle system, with each propulsion-generating vehicle of the vehicle system, with a lead vehicle of the vehicle system (that may then relay communicated messages between the non-lead vehicles of the vehicle system and the off-board control system), or any combination therein.

Figure 2:
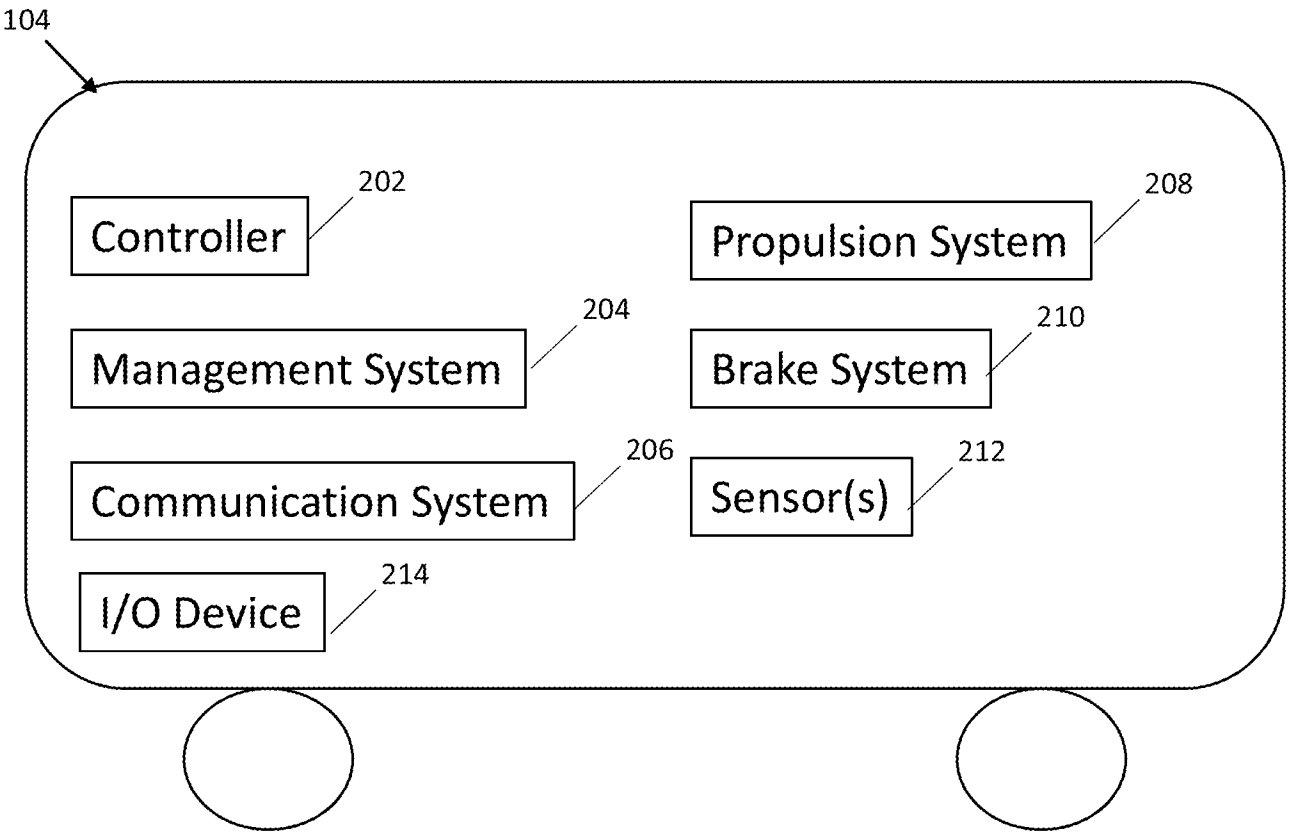
FIG. 2 illustrates a vehicle of the vehicle control system shown in FIG. 1.

FIG. 2 illustrates a schematic of one of the vehicles 104 shown in FIG. 1. The vehicle may be a propulsion-generating vehicle, and may include a controller 202 that represents hardware circuitry connected with and/or including one or more processors that perform the operations described herein in connection with the vehicle control system. The applications described herein may direct operation of the vehicle control system and/or other devices. Another device of the vehicle may be one or more sensors 212 that sense characteristics of the vehicle and/or vehicle system, other devices, the environment around the vehicle system, etc.

The vehicle may include a brake system 210. The brake system can represent one or more of friction brakes, air brakes, dynamic brakes (e.g., one or more of the traction motors of the propulsion system that also can generate braking effort via dynamic braking), or the like. In one or more embodiments, energy generated by the brake system via dynamic braking may be directed to the energy storage device where the energy may be stored for use within other systems of the vehicle system, or may be directed to a resistor grid (such as if the battery is at full capacity or the electrical generation is at a c-rate higher than desirable for a battery). The vehicle may include an input/output device 214 ("I/O Device" in FIG. 2), such as a touchscreen, keyboard, electronic mouse, electronic display other than a touchscreen, switch, lever, button, speaker, microphone, etc., used to present information to and/or receive information from operators of the powered system.

The vehicle may include a propulsion system 208 that can represent one or more components that are powered to propel the powered system or vehicle system, such as motors. Optionally, the propulsion system can include an engine and/or alternator or generator that operates to separately provide electric energy to power loads of the powered system (e.g., the motors). In one or more embodiments, the propulsion system may be operably coupled with one or more energy storage devices (not shown) that may provide power to one or more components of the propulsion system. Optionally, the propulsion system may generate power that may be directed to and stored within the one or more energy storage devices. Suitable energy storage devices may store energy that may be used to power auxiliary and/or non-auxiliary loads of the vehicle system. In one or more embodiments, the auxiliary loads can be powered by the energy storage devices and/or the propulsion system to perform work that does not propel the vehicle system. For example, the auxiliary loads can include display devices, monitoring devices (e.g., sensors), or the like.

In one or more embodiments, the vehicle and/or the vehicle system may be powered by one or more different fuel and/or energy types. With respect to the fuel, the fuel may be a single fuel type in one embodiment and in other embodiments the fuel may be a mixture of a plurality of different fuels. In one example of a fuel mixture, a first fuel may be liquid and a second fuel may be gaseous. A suitable liquid fuel may be diesel (regular, biodiesel, HDRD, and the like), gasoline, kerosene, dimethyl ether (DME), alcohol, and the like. A suitable gaseous fuel may be natural gas (methane) or a short chain hydrocarbon, hydrogen, ammonia, and the like. In one embodiment, fuel may be inclusive of stored energy as used herein. In that perspective, a battery state of charge, or a source of compressed gas, a flywheel, fuel cell, and other types of non-traditional fuel sources may be included. Optionally, the vehicle and/or vehicle system may be powered by electric energy (e.g., direct and/or alternating current). One or more energy sources may provide the electric energy to one or more loads, and the energy sources may include one or more fuel cells.

The vehicle may include a management system 204 that represents hardware circuitry including and/or connected with one or more processors that calculate and/or dictate operational settings of the vehicle system. This circuitry and/or the processors may be the same as or separate from (e.g., in addition to) the circuitry and/or processors of the controller. The management system may calculate settings to achieve one or more goals of the vehicle system subject to various constraints. As one example, the management system can determine a trip plan that dictates operational settings of the vehicle system at different locations, different times, different distances, etc., of upcoming travel of the vehicle system. These operational settings can cause the vehicle system to travel within the constraints (e.g., speed limits, forces exerted on the vehicle and/or the route, remaining a safe distance from other vehicles or objects, or the like) while driving the vehicle system toward achievement of the goal(s) (e.g., reducing fuel consumption, battery energy consumption, emission generation, reduce audible noise, etc.) relative to the vehicle system traveling within the constraints but using other settings. The operational settings can be throttle settings, brake settings, speeds, or the like.

The devices of the vehicle may be communicatively coupled with each other by a communication system 206. The communication system can be formed from communication pathways provided by or extending in conductive pathways (e.g., cables, buses, etc., such as Ethernet cables or connections) and/or wireless pathways. Some devices may be publisher devices or publishers that generate output. Some devices may be listener devices or listeners that obtain or receive the output from the publishers to perform some operation (e.g., control of the powered system, calculation of output, etc.). Some devices may be both publishers and listeners that receive data from another device, make a calculation, determination, etc. based on the received data, and generate data as an output for another device and/or perform some action (e.g., change operation of the powered system, such as changing a speed, throttle setting, etc., of a vehicle).

In one or more embodiments, the vehicle may include a memory or alternative data storage system (not shown). For example, a memory can store information about the vehicle, about different vehicles of the vehicle system, the route, historical trip information (e.g., information associated with how the vehicle system was automatically and/or manually controlled during previous trips along the route), historical trip information of other vehicle systems (e.g., information associated with how another vehicle system automatically and/or manually controlled during previous trips along the same route and/or along different routes), or the like. Optionally, the vehicle may receive data stored in a data storage device or memory of the off-board control system (not shown), data stored in another storage system (e.g., a cloud storage database and/or other virtual storage systems), or the like.

Figure 3:
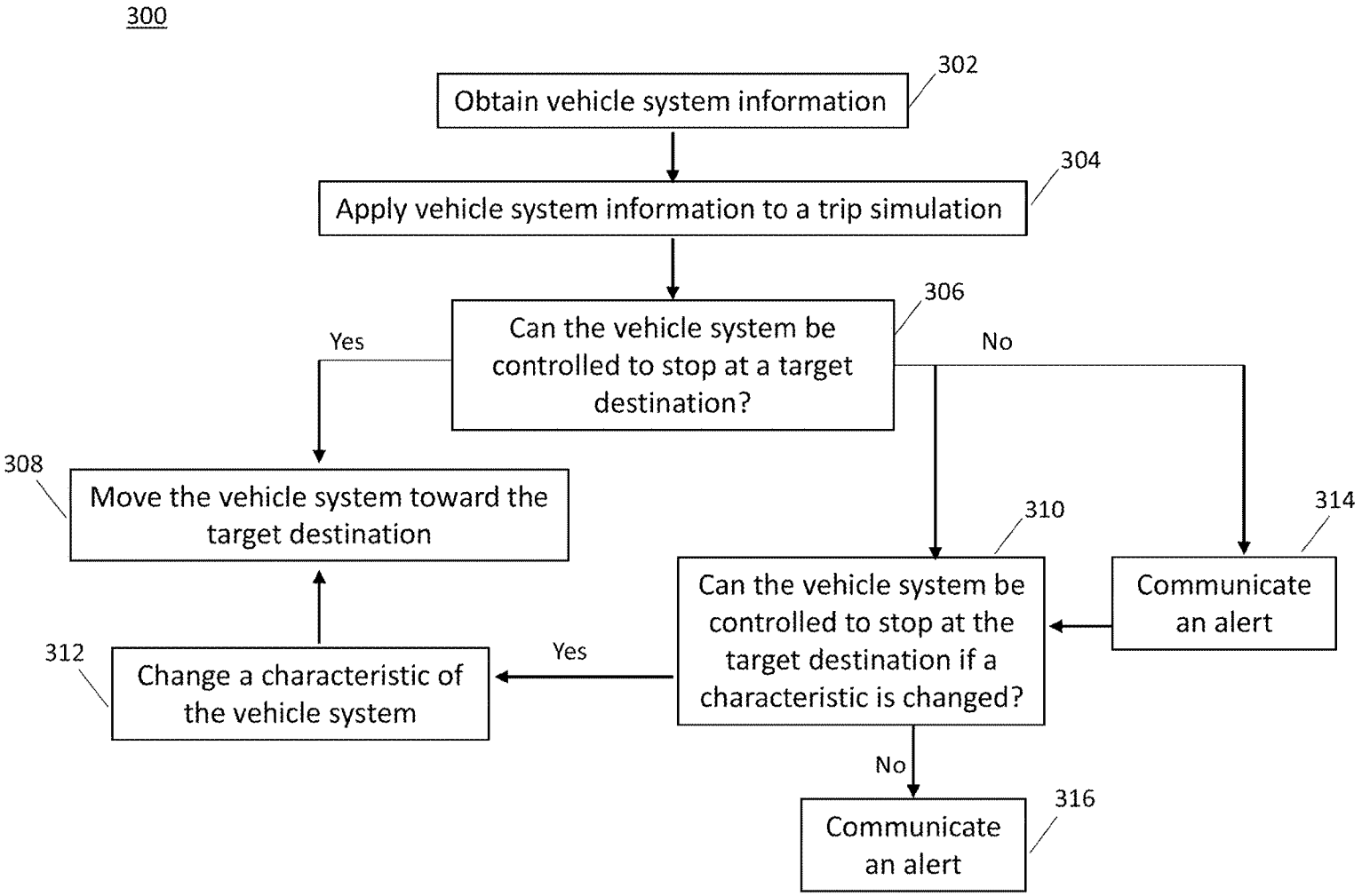
FIG. 3 illustrates a flowchart of one example of a method for examining how a vehicle system will operate, in accordance with one embodiment.

FIG. 3 illustrates a flowchart 300 of one example of a method for examining how a vehicle system will operate, in accordance with one embodiment. At step 302, vehicle system information may be obtained, such as by the controller of the vehicle (shown in FIG. 2), by a controller of the off-board control system, or the like. The vehicle system information may be information that is associated with the vehicle system, with vehicles of the vehicle system, or the like. For example, the vehicle system information may include, but is not limited to, a number of vehicles of the vehicle system, a location of one or more of the vehicles relative to other vehicles of the vehicle system (e.g., an arrangement or order of the vehicles in the consist), a number and/or placement of the propulsion-generating vehicle(s), the types of the vehicles of the vehicle system, a number and/or placement of the non-propulsion generating vehicle(s), power-generating capabilities of the propulsion-generating vehicle(s), a type, weight, and/or amount of cargo being carried by one or more of the vehicles, a weight-distribution of the cargo being carried along a length of the vehicle system, or the like.

In one embodiment, a portion of the vehicle system information may be obtained from the onboard memory storage device, another portion may be received from the off-board control system, another portion may be received from an operator of the vehicle system (e.g., an operator onboard the vehicle system and/or an operator off-board the vehicle system may manually input information associated with the vehicle system), or the like.

In one or more embodiments, the vehicle system information may need to be validated, such as to confirm that at least a portion of the vehicle system information that has been obtained and/or entered into the controller is accurate (e.g., accurate within a predetermined threshold). For example, at least one portion of the vehicle system information may be received from the off-board control system. The portion of the vehicle system information received from the off-board control system may be associated with a number of vehicles included in the vehicle consist. In one or more embodiments, the portion of the vehicle system information received from the off-board control system may need to be confirmed or validated to determine if the vehicle system information is correct. For example, the off-board control system may indicate that the vehicle system includes 100 vehicles that are mechanically coupled together to move along the route. The actual number of vehicles coupled together in the vehicle system may need to be validated or confirmed to be correct (or correct within about 5%, within about 10%, or the like), such as before the vehicle system starts to move along the route.

In one embodiment, the vehicle system information may be validated or confirmed by one or more operators of the vehicle system manually counting the vehicles of the vehicle system. For example, the operator(s) of the vehicle system may manually count the cars, and may enter the counted number of cars into the controller of the vehicle to compare the manually counted number of vehicles with the number of vehicles indicated by the off-board control system. If the numbers are different (e.g., different outside of a determined threshold), then the number of vehicles may need to be recounted or revalidated. Alternatively, if the numbers are the same (e.g., different within the determined threshold), then the vehicle system may be allowed to move along the route.

In one or more embodiments, the vehicle system information may be automatically validated, such as by the controller of the vehicle system and/or a controller of the off-board vehicle system. As one example, the vehicle system information may be automatically validated such as by applying the vehicle system information to a trip simulation. At step 304, the vehicle system information may be applied to a trip simulation. Applying the vehicle system information to the trip simulation may indicate how the vehicle system will operate or how the vehicle system is expected to operate relative to how the vehicle system will actually operate while the vehicle system moves along the route.

As one example, the controller of the vehicle system may receive and/or obtain the vehicle system information, and may apply the vehicle system information to the trip simulation. The trip simulation may be a predetermined model of a trip that the vehicle system is expected to travel. The trip simulation may include one or more anticipated operated conditions of the vehicle system, anticipated route conditions the vehicle system is expected to be exposed to as the vehicle system moves along the route, or the like. In one or more embodiments, the trip simulation may include a geographic area in which the vehicle system is traveling and/or scheduled to travel (e.g., elevation(s) above sea level, levels of human and/or other vehicle congestion, or the like), information related to the route the vehicle system is and/or will travel (e.g., route grades, route curves, expected tractive and/or braking forces, types of routes, locations of stops along the route, route crossings within a network of interconnecting routes, pedestrian and/or route crossings of other types of vehicles, or the like), or the like.

Additionally, the trip simulation may include a model of planned operational settings of the vehicle system at different locations, different times, different distances, etc., of the upcoming travel of the vehicle system. The operational settings may include brake settings and/or speed settings. For example, the operational settings may dictate how the braking system and/or propulsion system are to be operated at the different locations, different times, or different distances along the route. In one embodiment, the trip simulation may be determined and/or generated based on how the vehicle system was operated during previous trips along the same route. Optionally, the trip simulation may be determined and/or generated based on how other vehicle systems (e.g., similar vehicle systems, other vehicle systems of the same type, other vehicle systems having a common number of vehicles, or the like) were operated during previous trips along the same route. Optionally, the trip simulation may be determined and/or generated based on one or more constraints (e.g., speed limits, forces exerted on the vehicle and/or the route, remaining a safe distance from other vehicles or objects, or the like) while driving the vehicle system toward achievement of the goal(s) (e.g., reducing fuel consumption, battery energy consumption, emission generation, reduce audible noise, etc.) relative to the vehicle system traveling within the constraints but using other settings. For example, the trip simulation may be based at least in part on the trip plan.

In one or more embodiments, the trip simulation that may be generated by the controller and/or the management system of the vehicle system. Optionally, the trip simulation may be stored within the memory of the vehicle system. Optionally, the controller may receive the trip simulation (or receive a portion of the trip simulation) from the off-board control system. Optionally, an operator of the vehicle system may manually input (e.g., using the I/O devices) at least a portion of the trip simulation.

In one or more embodiments, the vehicle system information may be applied to the trip simulation while the vehicle system is stationary. For example, the trip simulation may occur before the vehicle system starts moving along the route, after the vehicle system has moved to and stopped at a specific location along the route, or the like. Alternatively, the trip simulation may occur while the vehicle system is moving along the route. For example, the vehicle system may be moving between a starting location and a first destination. Before the vehicle system reaches the first destination and while the vehicle system is moving along the route, the system information may be applied to the trip simulation, and the controller may run the trip simulation to examine how the vehicle system will operate between the first destination and a second destination that is further away from the first destination in the direction of travel of the vehicle system.

At step 306, a determination is made whether the vehicle system can be controlled to stop at a target destination along the route. For example, the vehicle system information may be applied to the trip simulation, and trip simulation may indicate how the vehicle system is expected to operate and/or perform, such as at different locations along the route. The trip simulation may include one or more destinations where the vehicle system will need to stop, or to slow to a determined speed. By applying the vehicle system information to the trip simulation, and seeing how the vehicle system is expected to operate, the controller and/or the operator of the vehicle system may determine that the vehicle system will be able to stop at a target destination when the vehicle system eventually actually moves along the route. Alternatively, the controller and/or the operator of the vehicle system may determine that the vehicle system will not be able to stop at the target destination when the vehicle system eventually actually moves along the route. In one or more embodiments, the target destination may be a stopping location, may be a distance range (e.g., within 1 meter of a target location, within 50 meters of the target location, or the like), may be a stop location that includes a range of distance ahead of the stop location (e.g., the vehicle system can stop within a target range ahead of the stop location, but may be prohibited from moving past the stop location), or the like.

If the simulation of the trip of the vehicle indicates that the vehicle system will be able to stop at the target destination, stop within a target destination range, or slow to a reduced speed at the target or within the target destination range, then flow of the method proceeds towards step 308. At step 308, the vehicle system may be allowed to actually travel along the route toward the target destination. For example, the controller may determine that the information associated with the vehicle system is accurate, or accurate within a designated threshold, and the vehicle system may be allowed to travel along the route.

In one or more embodiments, a message may be communicated (e.g., to an operator of the vehicle system or to the off-board control system) that indicates that the simulation of the trip of the vehicle system has been completed and that the vehicle system will be able to stop at or within a range of the target destination. Optionally, the simulation may indicate that the vehicle system will be able to stop at or within the range of the target destination, but that the vehicle system will exceed a constraint, or be outside of a determined acceptable range of a constraint. For example, the vehicle system may be able to stop at the target destination, but the trip simulation may determine that the vehicle system will be within an upper allowable range of a speed limit of an area approaching the target destination. Optionally, the trip simulation may determine that the vehicle system will be able to stop at the target destination, but that the vehicle system will exceed a designated threshold distance range of another vehicle system (e.g., a vehicle system that is moving along the same route ahead of the vehicle system). For example, the vehicle system may be too close to another vehicle system. The controller and/or an operator may determine whether it is acceptable for the vehicle system to move along the route even if the vehicle system will exceed the constraint.

Alternatively, if the simulation of the trip of the vehicle system indicates that the vehicle system will be unable to stop, or to slow to a designated speed, at a target destination or within a target destination range, then flow of the method proceeds toward step 310 and/or step 314. In one or more embodiments, step 314 may be eliminated from the flowchart.

At step 314, an alert may be communicated to an operator of the vehicle system, to an operator of the off-board control system, to operators of other vehicle systems, or the like. In one or more embodiments, the alert(s) may be initiated and/or communicated by the controller of the vehicle system and/or a controller of the off-board control system. Optionally, the alert(s) may be manually initiated by an operator of the vehicle system, or an operator off-board the vehicle system, such as an operator of the off-board control system.

From step 314, flow of the method may proceed toward step 310. At step 310, a decision is made whether the vehicle system will be able to stop at the target destination (e.g., within the trip simulation) if a characteristic of the vehicle system is changed. For example, if a portion of the information associated with the vehicle system is changed or updated, and the updated information is applied to the trip simulation, a determination is made whether the vehicle system will be able to stop at the target destination or within the target destination range.

In one embodiment, the alert communicated at step 314 may include a responsive action that may include direction(s) or recommendation(s) to change a characteristic of the vehicle system. The recommendation may be generated by the controller, a controller of the off-board control system, or the like. Optionally, the recommendation may be generated by an operator of the vehicle system, an operator of the off-board control system, or the like. In one or more embodiments, the recommendation may be communicated in addition to the alert. For example, the controller may initiate the alert responsive to determining that the vehicle system will be unable to stop at the target destination, and the controller of the off-board control system may review the trip simulation and communicate a recommendation indicating what characteristic(s) of the vehicle system should be changed. In one or more embodiments, the change in characteristic may be recommended by the controller of the vehicle system and/or a controller of the off-board vehicle system. Optionally, the change in characteristic may be recommended by an operator of the vehicle system or an operator of the off-board control system.

In one or more embodiments, the characteristic of the information associated with the vehicle system that may be changed may be to add one or more vehicles to the vehicle system, to remove one or more vehicles from the vehicle system, to change a position of one or more vehicles relative to locations of other vehicles, to change an amount of cargo being carried by one or more of the vehicles, to add or remove one or more propulsion-generating vehicles, to change a distribution of the cargo being carried by one of the vehicles, to change a position of one or more of the propulsion-generating vehicles in the vehicle system (e.g., relative to positions of other propulsion-generating vehicles and/or non-propulsion-generating vehicles), to change an amount of propulsion and/or braking effort that is provided by one or more of the propulsion-generating vehicle(s), or any combination therein.

If the simulation of the trip of the vehicle system with the application of the new or updated vehicle system information indicates that the vehicle system will still be unable to stop at the target destination or within the target destination range, then flow of the method proceeds toward step 316. At step 316, an alert may be communicated, such as to the operator of the vehicle system. The alert can indicate that the vehicle system is expected to not be able to stop at the target destination(s) even after the characteristic of the vehicle system is changed. Optionally, the alert may direct the vehicle system to not travel along the route.

Alternatively, if the simulation of the trip of the vehicle system with the application of the updated vehicle system information indicates that the vehicle system will be able to stop at the target destination or within the target destination range, then flow of the method proceeds toward step 312. At step 312, the characteristic of the vehicle system may be changed. For example, the characteristic that is to be changed may be to remove a vehicle from the vehicle system, add a vehicle of the vehicle system, rearrange propulsion-generating vehicles (e.g., relative to positions of other propulsion and non-propulsion-generating vehicles, rearrange non-propulsion-generating vehicles (e.g., relative to positions of other non-propulsion and propulsion-generating vehicles), change an amount of cargo being carried by one or more vehicles, change a position of a cargo-carrying vehicle (e.g., relative to other cargo-carrying vehicles and/or non-cargo-carrying vehicles), or the like.

Subsequent to the characteristic of the vehicle system being changed, flow of the method returns to step 308, and the vehicle system is controlled to move along the route toward the target destination.

In one or more embodiments, the flowchart 300 may be repeated at one or more different locations along the route. For example, the method may be completed before the vehicle system may be allowed to move away from a starting location along the route. Optionally, the method may be repeated one or more times while the vehicle system is moving along the route, after the vehicle system has reached one or more different target locations or designated distances along the route, responsive to one or more characteristics of the vehicle system changing (e.g., cargo being loaded and/or off-loaded, vehicles being added to or removed from the vehicle system, or the like), or the like. For example, first vehicle system information associated with the vehicle system at a first location may be applied to a first portion of a trip simulation. The first portion of the trip simulation may include anticipated operating conditions of the vehicle system and/or anticipated route conditions of the route between the first location (e.g., a starting location) and a second location (e.g., a first target destination). If the simulation of the first vehicle system information indicates that the vehicle system will be able to stop at the second location (e.g., the first target destination), then the vehicle system may be allowed to travel to the second location.

Responsive to the vehicle system reaching the second location, a characteristic of the vehicle system may change and generate second vehicle system information, that may be different than the first vehicle system information. For example, a distribution of the weight of cargo being carried may change, the number of vehicles of the vehicle system may change, or the like. The second vehicle system information associated with the change in characteristic of the vehicle system may be applied to a second portion of the trip simulation. The second portion of the trip simulation may include anticipated operating conditions of the vehicle system and/or anticipated route conditions of the route between the second location and a third location (e.g., a second target destination). The third location may be positioned ahead of the first and second locations along the route in the direction of travel of the vehicle system.

If the simulation of the second vehicle system information indicates that the vehicle system will be unable to stop at the third location (e.g., the second target destination), then the vehicle system may be prohibited from moving along the route toward the third location. Optionally, an alert may be communicated responsive to determining that the vehicle system will be unable to stop at the third location along the route according to the second trip simulation of the second vehicle system information.

In one embodiment, the control system may have a local data collection system deployed that may use machine learning to enable derivation-based learning outcomes. The control system may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and behavior analytics, and the like.

In one embodiment, the control system may include a policy engine that may apply one or more policies. These policies may be based at least in part on characteristics of a given item of equipment or environment. With respect to control policies, a neural network can receive input of a number of environmental and task-related parameters. These parameters may include an identification of a determined trip plan for a vehicle group, data from various sensors, and location and/or position data. The neural network can be trained to generate an output based on these inputs, with the output representing an action or sequence of actions that the vehicle group should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the control system may use evolution strategies techniques to tune various parameters of the artificial neural network. The control system may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle control system executes that plan to achieve the desired input data to mirror the predicted best outcome scenario. Additionally, the success metric may be a combination of the optimized outcomes, which may be weighed relative to each other.

The control system can use this artificial intelligence or machine learning to receive input (e.g., a location or change in location), use a model that associates locations with different operating modes to select an operating mode of the one or more functional devices of the HOV unit and/or EOV unit, and then provide an output (e.g., the operating mode selected using the model). The control system may receive additional input of the change in operating mode that was selected, such as analysis of noise or interference in communication signals (or a lack thereof), operator input, or the like, that indicates whether the machine-selected operating mode provided a desirable outcome or not. Based on this additional input, the control system can change the model, such as by changing which operating mode would be selected when a similar or identical location or change in location is received the next time or iteration. The control system can then use the changed or updated model again to select an operating mode, receive feedback on the selected operating mode, change or update the model again, etc., in additional iterations to repeatedly improve or change the model using artificial intelligence or machine learning.

In accordance with one example or aspect, a method may include obtaining information associated with a vehicle system that includes one or more vehicles that are configured to move along a route. The vehicle system information is applied to a trip simulation to determine how the vehicle system will actually operate while the vehicle system moves along the route. The trip simulation includes one or more anticipated operating conditions of the vehicle system and/or anticipated route conditions the vehicle system is expected to be exposed to as the vehicle system moves along the route. It is determined whether the vehicle system will be able to stop at one or more locations along the route based on the application of the vehicle system information to the trip simulation. An alert is communicated responsive to determining that the vehicle system will be unable to stop at the one or more locations along the route.

Optionally, the alert may include a responsive action directing an operator of the vehicle system to change one or more characteristics of the vehicle system. The method may include applying the vehicle system information to the trip simulation while the vehicle system is stationary, or applying the vehicle system information to the trip simulation while the vehicle system moves along the route. The method may include communicating a recommendation to change one or more characteristics of the vehicle system responsive to determining that the vehicle system will be unable to stop at the one or more locations along the route. The recommendation may include one or more of removing at least one vehicle from the vehicle system, adding at least one vehicle to the vehicle system, changing an amount of cargo being carried by at least one vehicle of the vehicle system, changing a position of at least one vehicle relative to at least one other vehicle. The vehicle system information may be first vehicle system information, and the method may include changing one or more characteristics of the vehicle system, wherein changing the one or more characteristics of the vehicle system changes the first vehicle system information to second vehicle system information. The second vehicle system information may be applied to the trip simulation, and a determination may be made whether the vehicle system will be able to stop at the one or more locations along the route based on the application of the second vehicle system information to the trip simulation. An alert may be communicated to one or more of an operator onboard the vehicle system or an operator offboard the vehicle system.

The method may include applying the vehicle system information to a first portion of the trip simulation, wherein the first portion of the trip simulation identifies a first location and a second location along the route. A determination may be made whether the vehicle system will be able to stop at the second location based on the application of the vehicle system information to the first portion of the trip simulation. The vehicle system may be controlled to move along the route between the first and second locations. The method may include applying the vehicle system information to a second portion of the trip simulation that identifies a third location and a fourth location along the route. The third and fourth locations may be positioned after the first and second locations in a direction of travel of the vehicle system along the route. A determination may be made that the vehicle system will be unable to stop at the fourth location based on the application of the vehicle system information to the second portion of the trip simulation. The alert may be communicated responsive to determining that the vehicle system will be unable to stop at the fourth locations along the route, and the vehicle system may be prohibited from moving along the route toward the fourth location.

In accordance with another example or aspect, a control system may include one or more processors that obtain information associated with a vehicle system. The vehicle system includes two or more vehicles that are configured to move along a route. The processors apply the vehicle system information to a trip simulation to determine how the vehicle system will actually operate while the vehicle system moves along the route. The trip simulation includes one or more of anticipated operating conditions of the vehicle system and/or anticipated route conditions the vehicle system is expected to be exposed to as the vehicle system moves along the route. The processors determine whether the vehicle system will be able to stop at one or more locations along the route based on the application of the vehicle system information to the trip simulation. Responsive to determining that the vehicle system may be unable to stop at the one or more locations along the route, the processors generate an alert.

The processors may apply the vehicle system information to the trip simulation while the vehicle system is stationary. The processors may apply the vehicle system information to the trip simulation while the vehicle system moves along the route. The control system may include a communication system that may communicate a recommendation to change one or more characteristics of the vehicle system responsive to determining that the vehicle system will be unable to stop at the one or more locations along the route. The recommendation may include one or more of removing at least one vehicle from the vehicle system, adding at least one vehicle to the vehicle system, changing an amount of cargo being carried by at least one vehicle of the vehicle system, or changing a position of at least one vehicle relative to a position of at least one other vehicle. The communication system may communicate the alert to an operator onboard the vehicle system and/or an operator off-board the vehicle system. The alert may include a responsive action directing an operator of the vehicle system to change one or more characteristics of the vehicle system. The processors may apply the vehicle system information to a first portion of the trip simulation that includes a first location and a second location along the route. The processors may control movement of the vehicle system to move along the route between the first and second locations responsive to determining that the vehicle system will be able to stop at the second location based on the application of the vehicle system information to the first portion of the trip simulation. The processors may apply the vehicle system information to a second portion of the trip simulation that includes a third and fourth location along the route. The processors may prohibit movement of the vehicle system along the route between the third and fourth locations responsive to determining that the vehicle system will be unable to stop at the fourth location based on the application of the vehicle system information to the second portion of the trip simulation.

In accordance with another example or aspect, a method may include applying vehicle system information to a trip simulation to determine how a vehicle system will actually operate while the vehicle system moves along a route. The trip simulation includes one or more of anticipated operating conditions of the vehicle system and/or anticipated route conditions the vehicle system is expected to be exposed to as the vehicle system moves along the route. A determination is made whether the vehicle system will exceed a determined operating threshold at one or more locations along the route based on the application of the vehicle system information to the trip simulation. The vehicle system may be allowed to move along the route responsive to determining that the vehicle system will not exceed the determined operating threshold, or the vehicle system may be prohibited from moving along the route responsive to determining that the vehicle system will exceed the determined operating threshold.

Use of phrases such as "one or more of . . . and," "one or more of . . . or," "at least one of . . . and," and "at least one of . . . or" are meant to encompass including only a single one of the items used in connection with the phrase, at least one of each one of the items used in connection with the phrase, or multiple ones of any or each of the items used in connection with the phrase. For example, "one or more of A, B, and C," "one or more of A, B, or C," "at least one of A, B, and C," and "at least one of A, B, or C" each can mean (1) at least one A, (2) at least one B, (3) at least one C, (4) at least one A and at least one B, (5) at least one A, at least one B, and at least one C, (6) at least one B and at least one C, or (7) at least one A and at least one C.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in another device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

As used herein, an element or step recited in the singular and preceded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function devoid of further structure.

This written description uses examples to disclose several embodiments of the subject matter, including the best mode, and to enable one of ordinary skill in the art to practice the embodiments of subject matter, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A method, comprising:

obtaining information associated with a vehicle system, the vehicle system including one or more vehicles configured to move along a route;

applying the information associated with the vehicle system to a trip simulation to determine how the vehicle system will operate while the vehicle system moves along the route, the trip simulation including one or more of anticipated operating conditions of the vehicle system or anticipated route conditions the vehicle system is expected to be exposed to as the vehicle system moves along the route;

determining that the vehicle system will be unable to stop at one or more locations along the route based on the application of the information to the trip simulation; and controlling the vehicle system to move along the route responsive to determining that the vehicle system will be unable to stop at the one or more locations along the route.

2. The method of claim 1, further comprising communicating an alert responsive to determining that the vehicle system will be unable to stop at the one or more locations along the route, wherein the alert includes a responsive action directing an operator of the vehicle system to change one or more characteristics of the vehicle system.

3. The method of claim 1, further comprising applying the information associated with the vehicle system to the trip simulation while the vehicle system is stationary.

4. The method of claim 1, further comprising applying the information associated with the vehicle system to the trip simulation while the vehicle system moves along the route.

5. The method of claim 1, further comprising communicating a recommendation to change one or more characteristics of the vehicle system responsive to determining that the vehicle system will be unable to stop at the one or more locations along the route.

6. The method of claim 5, wherein the recommendation includes one or more of removing at least one vehicle from the vehicle system, adding at least one vehicle to the vehicle system, changing an amount of cargo being carried by at least one vehicle of the vehicle system, or changing a position of at least one vehicle relative to a position of at least one other vehicle of the vehicle system.

7. The method of claim 5, wherein the information associated with the vehicle system is first vehicle system information, and further comprising:

changing the one or more characteristics of the vehicle system, wherein changing the one or more characteristics of the vehicle system changes the first vehicle system information to second vehicle system information;

applying the second vehicle system information to the trip simulation; and determining that the vehicle system will be able to stop at the one or more locations along the route based on the application of the second vehicle system information to the trip simulation.

8. The method of claim 1, further comprising communicating an alert to one or more of an operator onboard the vehicle system or an operator off-board the vehicle system responsive to determining that the vehicle system will be unable to stop at the one or more locations along the route.

9. The method of claim 1, further comprising:

applying the information associated with the vehicle system to a first portion of the trip simulation, the first portion of the trip simulation identifying a first location and a second location along the route;

determining that the vehicle system will be able to stop at the second location based on the application of the vehicle system information to the first portion of the trip simulation; and controlling the vehicle system to move along the route between the first and second locations.

10. The method of claim 9, further comprising:

applying the information associated with the vehicle system to a second portion of the trip simulation, the second portion of the trip simulation identifying a third location and a fourth location along the route, the third location and the fourth location being positioned after the first and second locations in a direction of travel of the vehicle system along the route;

determining that the vehicle system will be unable to stop at the fourth location based on the application of the information to the second portion of the trip simulation;

communicating an alert responsive to determining that the vehicle system will be unable to stop at the fourth location along the route; and prohibiting movement of the vehicle system along the route toward the fourth location.

11. A control system, comprising:

one or more processors configured to obtain information associated with a vehicle system, the vehicle system including two or more vehicles configured to move along a route, the one or more processors configured to apply the information associated with the vehicle system to a trip simulation to determine how the vehicle system will operate while the vehicle system moves along the route, the trip simulation including one or more of anticipated operating conditions of the vehicle system or anticipated route conditions the vehicle system is expected to be exposed to as the vehicle system moves along the route, wherein the one or more processors are configured to determine that the vehicle system will be unable to stop at one or more locations along the route based on the application of the information associated with the vehicle system to the trip simulation, and responsive to determining that the vehicle system will be unable to stop at the one or more locations along the route, the one or more processors configured to control movement of the vehicle system to move along the route.

12. The control system of claim 11, wherein the one or more processors are configured to apply the information associated with the vehicle system to the trip simulation while the vehicle system is stationary.

13. The control system of claim 11, wherein the one or more processors are configured to apply the information associated with the vehicle system to the trip simulation while the vehicle system moves along the route.

14. The control system of claim 11, further comprising a communication system configured to communicate a recommendation to change one or more characteristics of the vehicle system responsive to determining that the vehicle system will be unable to stop at the one or more locations along the route.

15. The control system of claim 14, wherein the recommendation includes one or more of removing at least one vehicle from the vehicle system, adding at least one vehicle to the vehicle system, changing an amount of cargo being carried by at least one vehicle of the vehicle system, or changing a position of at least one vehicle relative to a position of at least one other vehicle of the vehicle system.

16. The control system of claim 14, wherein responsive to determining that the vehicle system will be unable to stop at the one or more locations along the route, the one or more processors is configured to generate an alert, and the communication system is configured to communicate the alert to one or more of an operator onboard the vehicle system or an operator off-board the vehicle system.

17. The control system of claim 11, wherein responsive to determining that the vehicle system will be unable to stop at the one or more locations along the route, the one or more processors is configured to generate an alert, and the alert includes a responsive action directing an operator of the vehicle system to change one or more characteristics of the vehicle system.

18. The control system of claim 11, wherein the one or more processors are configured to apply the information associated with the vehicle system to a first portion of the trip simulation that includes a first location and a second location along the route, wherein the one or more processors are configured to control movement of the vehicle system to move along the route between the first and second locations responsive to determining that the vehicle system will be able to stop at the second location based on the application of the information associated with the vehicle system to the first portion of the trip simulation.

19. The control system of claim 11, wherein the one or more processors are configured to apply the information associated with the vehicle system to a second portion of the trip simulation that includes a third location and a fourth location along the route, wherein the one or more processors are configured to prohibit movement of the vehicle system along the route between the third and fourth locations responsive to determining that the vehicle system will be unable to stop at the fourth location based on the application of the information associated with the vehicle system to the second portion of the trip simulation.

20. A method, comprising:

applying vehicle system information to a trip simulation to determine how a vehicle system will operate during upcoming movement of the vehicle system along a route, the trip simulation including one or more of anticipated operating conditions of the vehicle system or anticipated route conditions the vehicle system is expected to be exposed to during the upcoming movement of the vehicle system along the route;

determining whether the vehicle system will exceed a determined operating threshold at one or more locations along the route based on the application of the vehicle system information to the trip simulation; and one of allowing movement of the vehicle system to move along the route responsive to determining that the vehicle system will not exceed the determined operating threshold, or prohibiting movement of the vehicle system to move along the route responsive to determining that the vehicle system will exceed the determined operating threshold.

* * * * *